US005839123A

United States Patent [19]

Dunham, Sr.

[11] Patent Number: 5,839,123

[45] Date of Patent: Nov. 24, 1998

[54] INSERT FOR HANDHELD URINALS

[76] Inventor: David J. Dunham, Sr., 131 Bridge St., Salem, Mass. 01970-3923

[21] Appl. No.: 941,876

[22] Filed: Sep. 30, 1997

[51] Int. Cl.[6] ..... A61G 9/00

[52] U.S. Cl. ..... 4/144.1; 604/323

[58] Field of Search ..... 4/144.1–144.4, 4/454; 604/323, 335, 350

[56] References Cited

U.S. PATENT DOCUMENTS

| | | | |
|---|---|---|---|
| 703,131 | 6/1902 | Jaenel | 4/144.3 |
| 2,358,850 | 9/1944 | Chenault | 4/144.1 |
| 3,725,962 | 4/1973 | Gouget | 4/144.2 |
| 5,592,699 | 1/1997 | Jensen | 4/144.1 |

FOREIGN PATENT DOCUMENTS

| | | | |
|---|---|---|---|
| 526676 A1 | 2/1993 | European Pat. Off. | 4/144.1 |
| 30413 | 12/1909 | United Kingdom | 4/144.4 |
| 561707 | 6/1944 | United Kingdom | 4/144.4 |

*Primary Examiner*—Charles R. Eloshway

[57] ABSTRACT

An insert for handheld urinals for eliminating backflow and spillage of urine includes a funnel portion adapted for securement within a standard handheld urinal bottle. The funnel portion has a central cylindrical portion and an upwardly extending tapered portion. The central cylindrical portion is positionable within an upwardly extending neck of the urinal bottle. The central cylindrical portion has a peripheral gasket disposed on an upper end thereof. The peripheral gasket engages an open mouth of the urinal bottle.

3 Claims, 2 Drawing Sheets

INSERT FOR HANDHELD URINALS

BACKGROUND OF THE INVENTION

1. Field of the Invention

The present invention relates to urine collection devices and more particularly pertains to a new insert for handheld urinals for eliminating backflow and spillage of urine.

2. Description of the Prior Art

The use of urine collection devices is known in the prior art. More specifically, urine collection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art urine collection devices include U.S. Pat. No. 4,064,760 to Benjamin; U.S. Pat. No. 4,741,346 to Wong et al.; U.S. Pat. No. Des. 269,378 to Work; U.S. Pat. No. 5,074,343 to Tyree et al.; U.S. Pat. No. 5,117,878 to Shaw et al.; and U.S. Pat. No. 4,286,885 to Uibel et al.

While these devices fulfill their respective, particular objectives and requirements, the aforementioned patents do not disclose a new insert for handheld urinals. The inventive device includes a funnel portion adapted for securement within a standard handheld urinal bottle. The funnel portion has a central cylindrical portion and an upwardly extending tapered portion. The central cylindrical portion is positionable within an upwardly extending neck of the urinal bottle. The central cylindrical portion has a peripheral gasket disposed on an upper end thereof. The peripheral gasket engages an open mouth of the urinal bottle.

In these respects, the insert for handheld urinals according to the present invention substantially departs from the conventional concepts and designs of the prior art, and in so doing provides an apparatus primarily developed for the purpose of eliminating backflow and spillage of urine.

SUMMARY OF THE INVENTION

In view of the foregoing disadvantages inherent in the known types of urine collection devices now present in the prior art, the present invention provides a new insert for handheld urinals construction wherein the same can be utilized for eliminating backflow and spillage of urine.

The general purpose of the present invention, which will be described subsequently in greater detail, is to provide a new insert for handheld urinals apparatus and method which has many of the advantages of the urine collection devices mentioned heretofore and many novel features that result in a new insert for handheld urinals which is not anticipated, rendered obvious, suggested, or even implied by any of the prior art urine collection devices, either alone or in any combination thereof.

To attain this, the present invention generally comprises a urinal bottle having a generally rectangular configuration. The urinal bottle has an upwardly extending neck with an open mouth. The open mouth has an outwardly extending peripheral flange. The urinal bottle has a handle disposed on an upper end thereof. A funnel portion is adapted for securement within the urinal bottle. The funnel portion has a central cylindrical portion and an upwardly extending tapered portion. The central cylindrical portion is positioned within the upwardly extending neck. The central cylindrical portion has a peripheral gasket disposed on an upper end thereof. The peripheral gasket engages the outwardly extending peripheral flange of the open mouth. The peripheral gasket has an inwardly extending tab disposed around a periphery thereof. The peripheral gasket has an upwardly extending orientation tab. The orientation tab corresponds with an open lower end of the upwardly extending tapered portion for positioning the open lower end at its highest elevation within the urinal bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insert for handheld urinals apparatus and method which has many of the advantages of the urine collection devices mentioned heretofore and many novel features that result in a new insert for handheld urinals which is not anticipated, rendered obvious, suggested, or even implied by any of the prior art urine collection devices, either alone or in any combination thereof.

It is another object of the present invention to provide a new insert for handheld urinals which may be easily and efficiently manufactured and marketed.

It is a further object of the present invention to provide a new insert for handheld urinals which is of a durable and reliable construction.

An even further object of the present invention is to provide a new insert for handheld urinals which is susceptible of a low cost of manufacture with regard to both materials and labor, and which accordingly is then susceptible of low prices of sale to the consuming public, thereby making such insert for handheld urinals economically available to the buying public.

Still yet another object of the present invention is to provide a new insert for handheld urinals which provides in the apparatuses and methods of the prior art some of the advantages thereof, while simultaneously overcoming some of the disadvantages normally associated therewith.

Still another object of the present invention is to provide a new insert for handheld urinals for eliminating backflow and spillage of urine.

Yet another object of the present invention is to provide a new insert for handheld urinals which includes a funnel portion adapted for securement within a standard handheld urinal bottle. The funnel portion has a central cylindrical portion and an upwardly extending tapered portion. The central cylindrical portion is positionable within an upwardly extending neck of the urinal bottle. The central cylindrical portion has a peripheral gasket disposed on an upper end thereof. The peripheral gasket engages an open mouth of the urinal bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
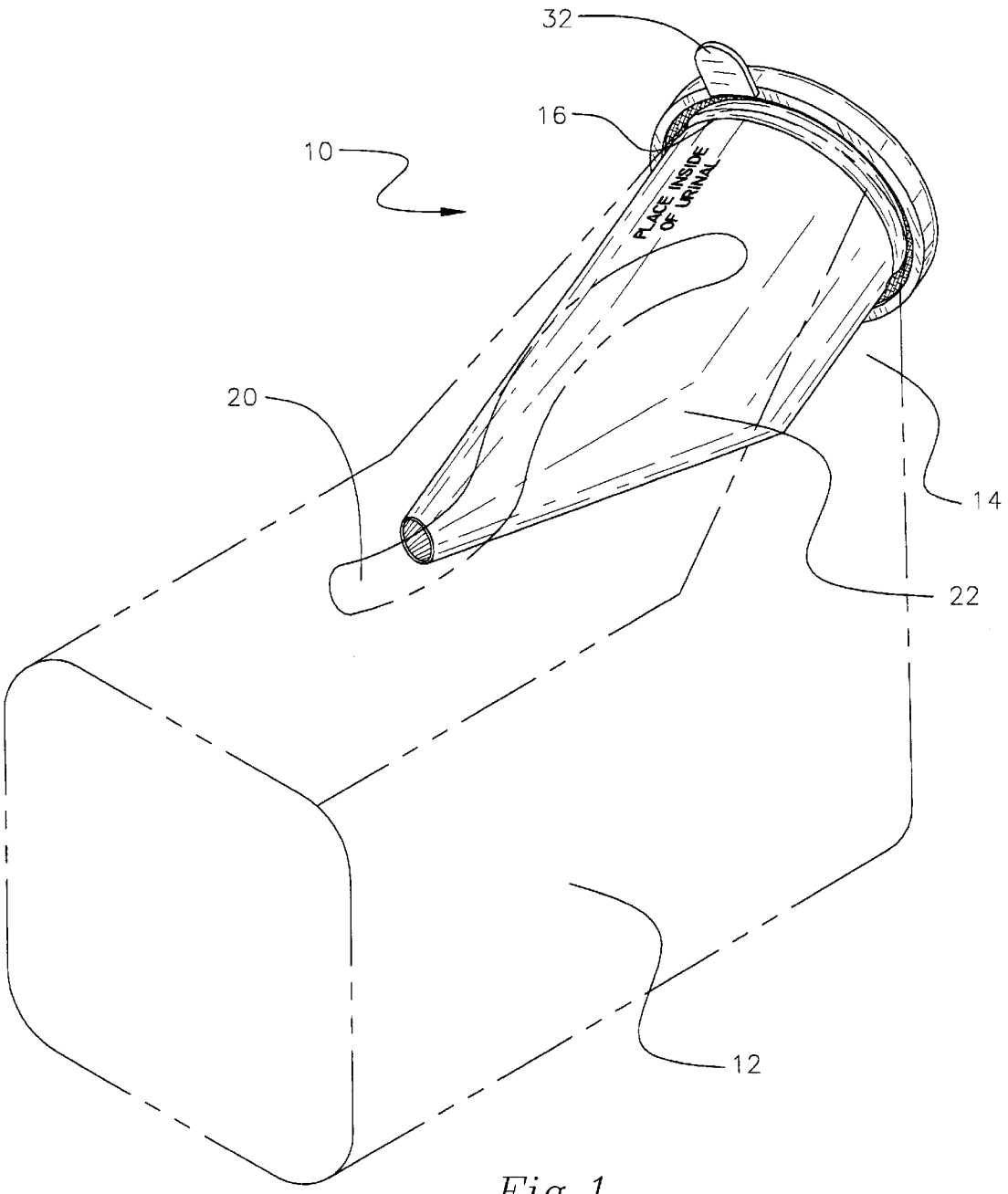
FIG. 1 is a perspective view of a new insert for handheld urinals according to the present invention.
Figure 2:
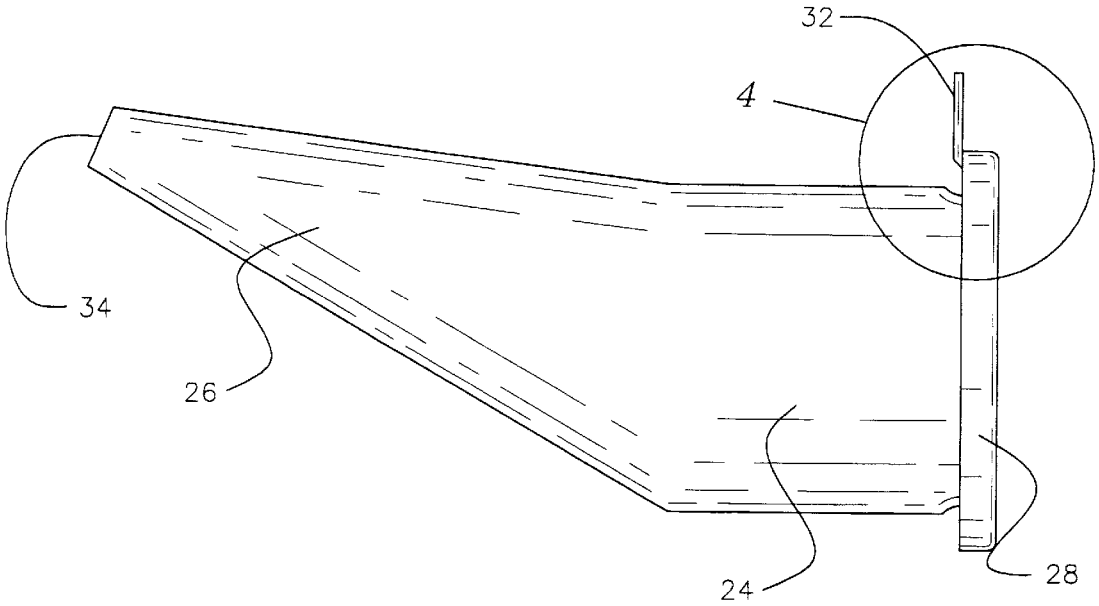
FIG. 2 is a side elevation view of the present invention.
Figure 3:
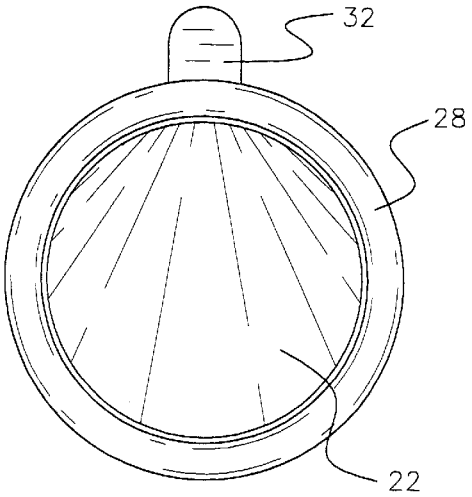
FIG. 3 is a front elevation view of the present invention.
Figure 4:
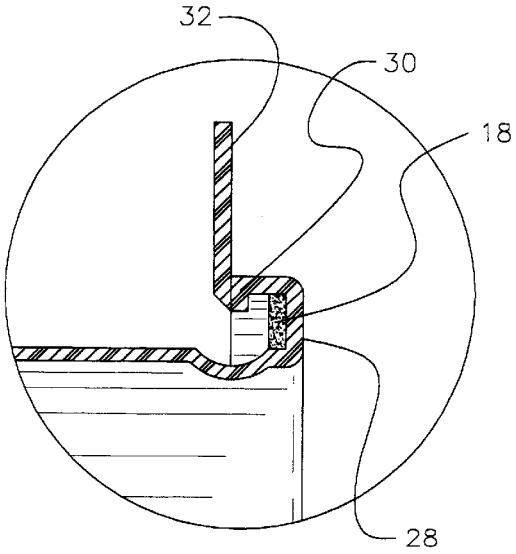
FIG. 4 is a sectional view of the present invention as taken from circle 4 of FIG. 2.

With reference now to the drawings, and in particular to FIGS. 1 through 4 thereof, a new insert for handheld urinals embodying the principles and concepts of the present invention and generally designated by the reference numeral 10 will be described.

As best illustrated in FIGS. 1 through 4, the insert for handheld urinals 10 comprises a urinal bottle 12 having a generally rectangular configuration. The urinal bottle 12 has an upwardly extending neck 14 with an open mouth 16. The open mouth 16 has an outwardly extending peripheral flange 18. The urinal bottle 12 has a handle 20 disposed on an upper end thereof.

A funnel portion 22 is adapted for securement within the urinal bottle 12. The funnel portion 22 has a central cylindrical portion 24 and an upwardly extending tapered portion 26. The central cylindrical portion 24 is positioned within the upwardly extending neck 14. The central cylindrical portion 14 has a peripheral gasket 28 disposed on an upper end thereof. The peripheral gasket 28 engages the outwardly extending peripheral flange 18 of the open mouth 16. The peripheral gasket 28 has an inwardly extending tab 30 disposed around a periphery thereof. The peripheral gasket 28 has an upwardly extending orientation tab 32. The orientation tab 32 corresponds with an open lower end 34 of the upwardly extending tapered portion 26 for positioning the open lower end 34 at its highest elevation within the urinal bottle 12.

In use, the funnel portion 22 would snap in place over the open mouth 16 of the urinal bottle 12. The peripheral gasket 28 would seal the device 10. The funnel portion 22 would cause the open mouth 16 of the urinal bottle 12 to be slightly decreased in diameter for greater comfort, and the entire funnel portion 22 would be narrower and tilted at a steeper angle that the conventional product currently available. This design would ensure that the urine collected within the urinary bottle 12 would not backflow towards the open mouth 16. With the funnel portion 22 in position, urine would collect behind it and underneath it, preventing it from reaching the open mouth 16 of the urinal bottle 12 and making contact with the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handheld urinal for eliminating backflow and spillage of urine comprising, in combination:

a urinal bottle having a generally rectangular configuration, the urinal bottle having a top with an upwardly extending neck with an open mouth, the open mouth having an outwardly extending peripheral flange, the urinal bottle having a handle disposed on the top of the urinal bottle;

a funnel portion adapted for securement within the urinal bottle, the funnel portion having a central cylindrical portion and an upwardly extending tapered portion terminating in an open lower end, the tapered portion having a longitudinal axis oriented at an obtuse angle with respect to a longitudinal axis of the central cylindrical portion such that the tapered portion is angled toward an interior surface of the top of the urinal bottle and the open lower end of the tapered portion is positioned adjacent to the interior surface of the top of the urinal bottle when the funnel portion is secured to the urinal bottle, the central cylindrical portion positioned within the upwardly extending neck, the central cylindrical portion having a peripheral gasket disposed on an upper end thereof, the peripheral gasket engaging the outwardly extending peripheral flange of the open mouth, the peripheral gasket having an inwardly extending ridge disposed around a periphery thereof, the peripheral gasket having an upwardly extending orientation tab, the orientation tab corresponding to the direction of the obtuse angle of the upwardly extending tapered portion for providing a visual indication of the obtuse angle direction for positioning the open lower end at its highest elevation within the urinal bottle.

2. A new insert for handheld urinals for eliminating backflow and spillage of urine comprising, in combination:

a funnel portion adapted for securement within a standard handheld urinal bottle, the funnel portion having a central cylindrical portion and an upwardly extending tapered portion, the central cylindrical portion positionable within an upwardly extending neck of the urinal bottle, the tapered portion having a longitudinal axis oriented at an obtuse angle with respect to a longitudinal axis of the central cylindrical portion such that an open lower end of the funnel portion is positioned adjacent an upper interior surface of the urinal bottle and the tapered portion is angled toward the upper interior surface when the funnel portion is secured to the urinal bottle, the central cylindrical portion having a peripheral gasket disposed on an upper end thereof, the peripheral gasket adapted for engaging an open mouth of the urinal bottle, the peripheral gasket having an upwardly extending orientation tab, the orientation tab corresponding to the direction of the obtuse angle of the upwardly extending tapered portion for providing a visual indication of the obtuse angle direction for positioning the open lower end at its highest elevation within the urinal bottle.

3. The insert for handheld urinals as set forth in claim 2 wherein the peripheral gasket has an inwardly extending ridge disposed around a periphery thereof for facilitating secure engagement of the insert to a peripheral flange surrounding the open mouth of the urinal bottle.

* * * * *